US011206965B1

(12) United States Patent
Greenwood

(10) Patent No.: US 11,206,965 B1
(45) Date of Patent: Dec. 28, 2021

(54) ADJUSTABLE RACK

(71) Applicant: YouCopia Products, Inc., Chicago, IL (US)

(72) Inventor: Mark Greenwood, Arlington Heights, IL (US)

(73) Assignee: YouCopia Products, Inc., Chicago, IL (US)

( * ) Notice: Subject to any disclaimer, the term of this patent is extended or adjusted under 35 U.S.C. 154(b) by 0 days.

(21) Appl. No.: 17/235,050

(22) Filed: Apr. 20, 2021

(51) Int. Cl.
*A47L 19/04* (2006.01)
*A47B 45/00* (2006.01)
*A47B 57/58* (2006.01)

(52) U.S. Cl.
CPC ..... *A47L 19/04* (2013.01); *A47B 45/00* (2013.01); *A47B 57/58* (2013.01)

(58) Field of Classification Search
CPC ..... A47B 45/00; A47B 57/58; A47B 57/585; A47B 57/586; A47B 57/588; A47B 57/00; A47B 57/48; A47B 57/482; A47B 46/00; A47B 96/04; A47B 96/025; A47B 65/10; A47B 65/15; A47F 5/005; A47L 19/04
See application file for complete search history.

(56) References Cited

U.S. PATENT DOCUMENTS 729,078 A * 5/1903 Maxwell ..... B65D 21/086 220/8
872,837 A * 12/1907 Mio ..... B28B 7/02 249/157
876,235 A * 1/1908 Quackenboss ..... A01G 9/02 47/66.1
1,023,297 A * 4/1912 Chambers ..... A47B 57/58 108/61
1,523,136 A * 1/1925 O'Connor ..... B25H 3/06 220/533
1,712,054 A * 5/1929 Sheard ..... A47B 57/58 108/61
1,767,397 A * 6/1930 Ragland ..... A47F 5/005 312/140
2,221,024 A * 11/1940 Hood ..... G03B 21/64 220/533
2,483,769 A * 10/1949 Hickey ..... A47F 5/005 312/140.3
2,788,912 A * 4/1957 Simonsen ..... B65D 25/06 220/533
2,915,193 A * 12/1959 Bromberg ..... A47F 5/005 108/61
3,463,343 A * 8/1969 Asenbauer ..... B65D 21/086 220/8
3,554,429 A * 1/1971 Cohen ..... B65D 5/48046 229/120.34
4,036,369 A * 7/1977 Eisenberg ..... A47B 45/00 211/88.02

(Continued)

*Primary Examiner* — Jonathan Liu
*Assistant Examiner* — Devin K Barnett
(74) *Attorney, Agent, or Firm* — Lowe Graham Jones PLLC

(57) ABSTRACT

An adjustable rack suitable for storing lids or other items vertically includes a base platform in two sections telescopically attached to one another and having pluralities of slots formed in sidewalls of the base sections. A plurality of dividers are selectively attached to the rack at any of the plurality of slots. A lock allows the base sections to be secured in a selected position which is either extended or collapsed.

20 Claims, 11 Drawing Sheets

(56) References Cited

U.S. PATENT DOCUMENTS 4,436,215 A * 3/1984 Kleinert ..... A47B 88/975 220/533
4,759,449 A * 7/1988 Gold ..... A47B 57/58 211/184
4,768,661 A * 9/1988 Pfeifer ..... A47F 5/005 211/184
5,016,772 A * 5/1991 Wilk ..... B65D 21/086 220/495.01
5,299,688 A * 4/1994 McKay ..... B42F 17/02 206/425
6,073,794 A * 6/2000 Bidot ..... A47B 88/975 220/529
6,390,359 B1 * 5/2002 Lin ..... A47B 88/975 229/198
6,959,811 B1 * 11/2005 Hoover ..... A01K 97/06 206/315.11
7,380,894 B2 * 6/2008 Berger ..... A47B 88/994 312/348.3
7,464,827 B2 * 12/2008 Meissen ..... B65D 21/0212 206/557
8,317,040 B2 * 11/2012 Lanning ..... A47B 88/969 211/184
8,608,262 B1 * 12/2013 Daros ..... A47B 88/941 312/348.2
8,668,123 B2 * 3/2014 Richmond ..... B60R 11/02 224/312
9,382,040 B2 * 7/2016 Huang ..... B65D 21/086
D846,281 S * 4/2019 Greenwood ..... D3/313
D848,151 S * 5/2019 Greenwood ..... D3/313
D925,227 S * 7/2021 Hazelton ..... D3/304
D925,228 S * 7/2021 Hazelton ..... D3/304
2003/0034319 A1 * 2/2003 Meherin ..... A47F 5/005 211/184
2004/0145287 A1 * 7/2004 Ernst ..... A47B 88/90 312/348.3
2004/0245254 A1 * 12/2004 Rosenberg ..... A47B 88/90 220/507
2007/0062839 A1 * 3/2007 Patterson ..... B65D 25/06 206/523
2007/0159040 A1 * 7/2007 Fernandez ..... B25H 3/023 312/348.3
2008/0083753 A1 * 4/2008 Escobar ..... B65D 25/06 220/8
2008/0202976 A1 * 8/2008 Burgess ..... A47B 88/994 206/558
2008/0295976 A1 * 12/2008 Watanabe ..... A47B 88/975 160/131
2014/0001134 A1 * 1/2014 Merey ..... A47B 97/00 211/86.01
2014/0124406 A1 * 5/2014 Ishikawa ..... B65D 21/0213 206/557
2015/0359336 A1 * 12/2015 Henn ..... A47B 96/02 211/132.1
2016/0176577 A1 * 6/2016 Frankenberg ..... B65D 1/22 220/533
2018/0362212 A1 * 12/2018 Bahr ..... B65D 25/06
2020/0331654 A1 * 10/2020 Reid ..... A47G 7/044

* cited by examiner

ADJUSTABLE RACK

BACKGROUND OF THE INVENTION

Many kitchen items can be difficult to store in an efficient manner. Lids for food storage containers, for example, come in many different shapes and sizes and typically do not stack atop one another very well. If they can be supported on-end in a stable manner then they can be placed side-by-side and stored in a relatively small space. Existing racks for storing lids or other such items in a vertical manner suffer from various defects, such as not being easily reconfigurable or resized to fit multiple cupboard or drawer dimensions.

SUMMARY OF THE INVENTION

A preferred version of the adjustable rack includes a base having a first base section telescopically connected to a second base section. The first base section has a first floor section, a first sidewall and an opposing second sidewall, and a first end wall between the first sidewall and the second sidewall, the first sidewall having an interior sidewall surface separated from an exterior sidewall surface by a first channel, the second sidewall having an interior sidewall surface separated from an exterior sidewall surface by a second channel. The second base section has a second floor section, a third sidewall and an opposing fourth sidewall, and a second end wall between the third sidewall and the fourth sidewall, the third sidewall having an interior sidewall surface separated from an exterior sidewall surface by a third channel, the fourth sidewall having an interior sidewall surface separated from an exterior sidewall surface by a fourth channel.

A first plurality of slots is arranged along the interior surfaces of the first sidewall and the second sidewall, and a second plurality of slots is arranged along the interior surfaces of the third sidewall and the fourth sidewall. At least some of the first plurality of slots are positioned to overlap with the first plurality of slots when the first base section is telescopically connected to the second base section in a collapsed position to form overlapping slots.

The third sidewall is received within the first channel and the fourth sidewall is received within the second channel when the first base section is telescopically connected to the second base section.

A first locking tab is formed on the second base section to releasably secure the first base section to the second base section in a collapsed position or an expanded position.

A plurality of dividers is preferably included, each of the dividers including first tab and a second tab, each one of the first tabs and the second tabs being removably receivable within a selected one of the first plurality of lots, the second plurality of slots, or the overlapping slots.

In preferred versions, the first locking tab includes a first horizontal foot separated from the second floor section by a first gap, the first gap further extending upwardly along a portion of the first sidewall.

Preferred versions may further include a second locking tab, the second locking tab having a second horizontal foot separated from the second floor section by a second gap, the second gap further extending upwardly along a portion of the second sidewall.

Most preferably, the first locking tab further comprises a first tongue, the first tongue being positioned on the interior sidewall surface of the third sidewall.

In some versions, the first plurality of slots extend to a first height above the second floor section when the first base section is telescopically connected to the second base section, and the second plurality of slots extend to a second height above the second floor section when the first base section is telescopically connected to the second base section, the first height being greater than the second height.

Most preferably, the lower tab is sized to extend through a slot from among the first plurality of slots and a slot from among the second plurality of slots, and wherein the upper tab is sized to extend through a slot from among the first plurality of slots but is larger than the slots forming the second plurality of slots.

In some versions, the upper tab abuts the third sidewall when the lower tab extends through the selected one of the first plurality of slots overlapping with the second plurality of slots.

Preferably, each of the dividers is planar and includes a first side, a second side, a top, and a bottom, and further wherein each of the opposing tabs comprises a stepped divider tab having an upper tab and a lower tab, the lower tab extending laterally outward beyond the upper tab.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
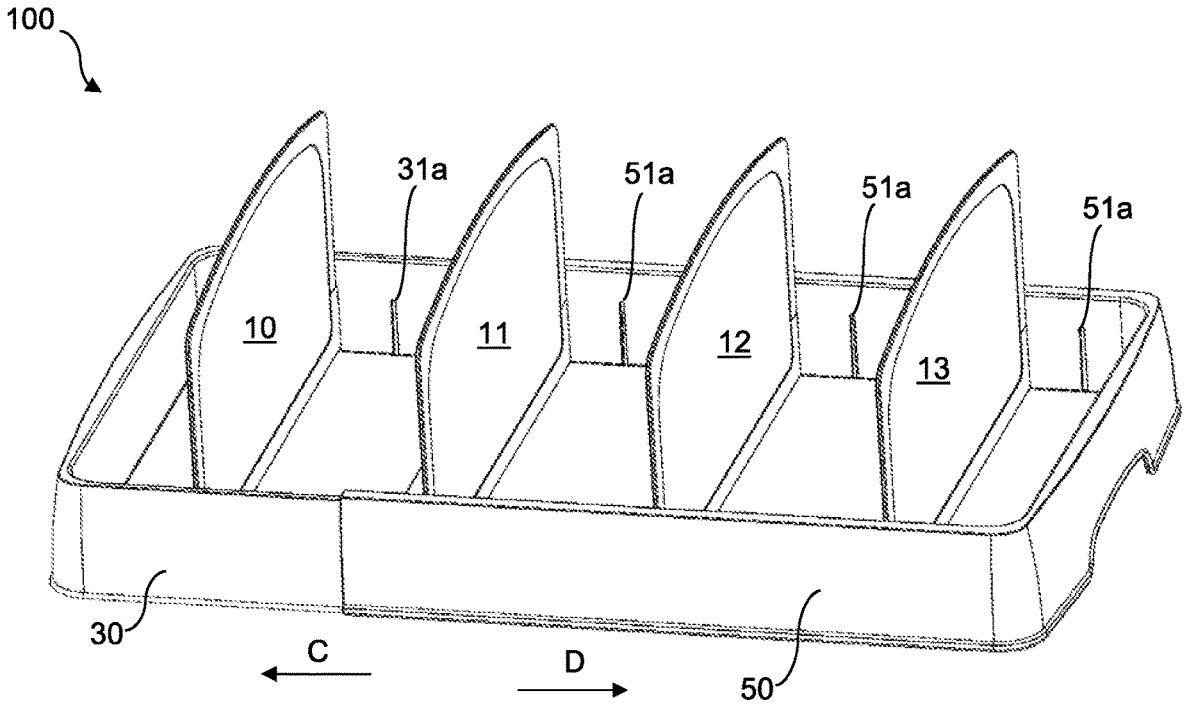
FIG. 1 is a front top perspective view of an exemplary adjustable rack.

An exemplary adjustable rack 100 is shown in the accompanying figures, including a top perspective view in FIG. 1. The preferred adjustable rack includes a first base section 50 and a second base section 30. The first and second base sections cooperate to form the base for the adjustable rack, and in the illustrated example the are telescopically connected to one another such that they may move apart from one another in the directions indicated by arrows C and D in order to expand the base, or move toward one another in the opposite directions to collapse it. The adjustable rack 100 includes one or more dividers 10-13 which may be selectively positioned in slots 31*a* formed in the second base section 30 or slots 51*a* formed in the first base section. The divider slots are provided in pairs on opposite sidewalls of the base, but only the first side slots 31*a*, 51*a* are visible in FIG. 1.

Figure 2:
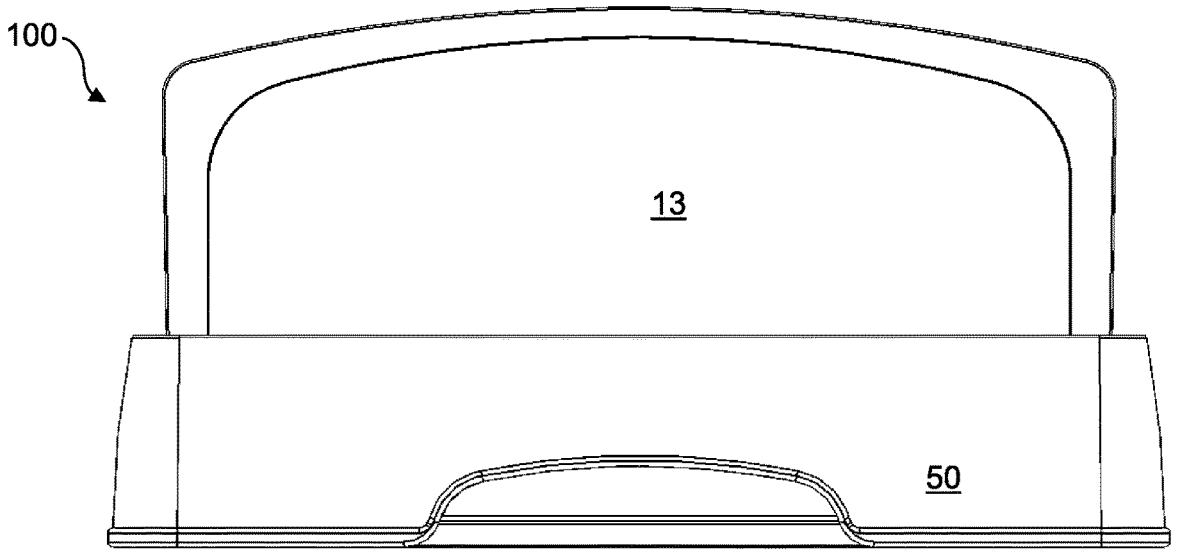
FIG. 2 is a right side elevational view of the adjustable rack.
Figure 3:
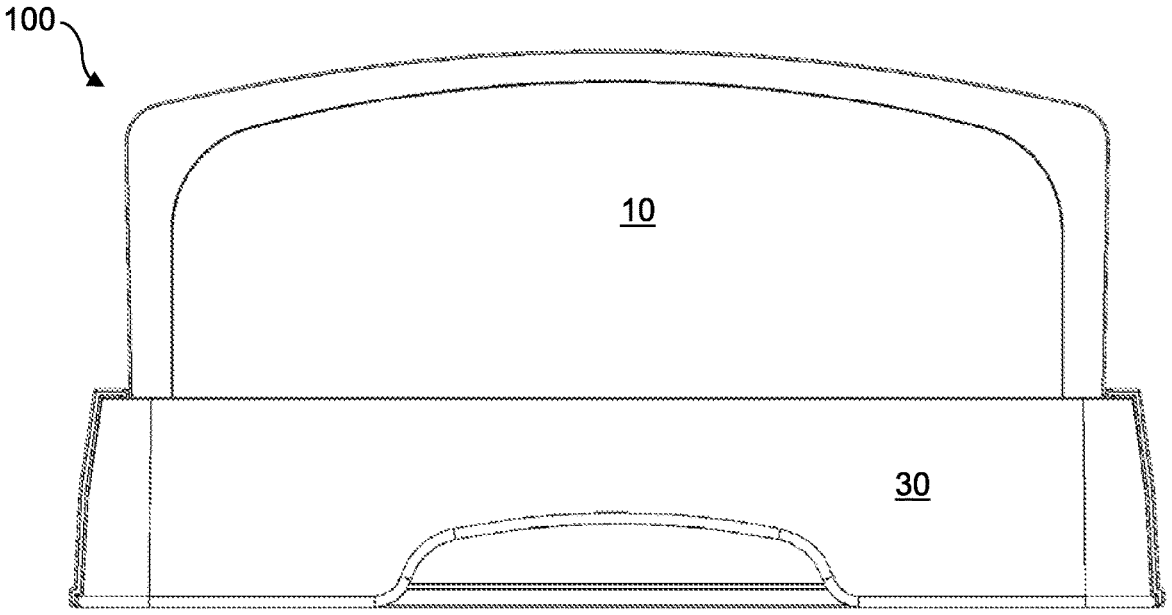
FIG. 3 is a left side elevational view of the adjustable rack.

FIGS. 2 and 3 illustrate right side and left side elevational views of the preferred adjustable rack, primarily showing either the first base section 50 or the second base section 30, and an applicable one of the dividers 10 or 13.

Figure 4:
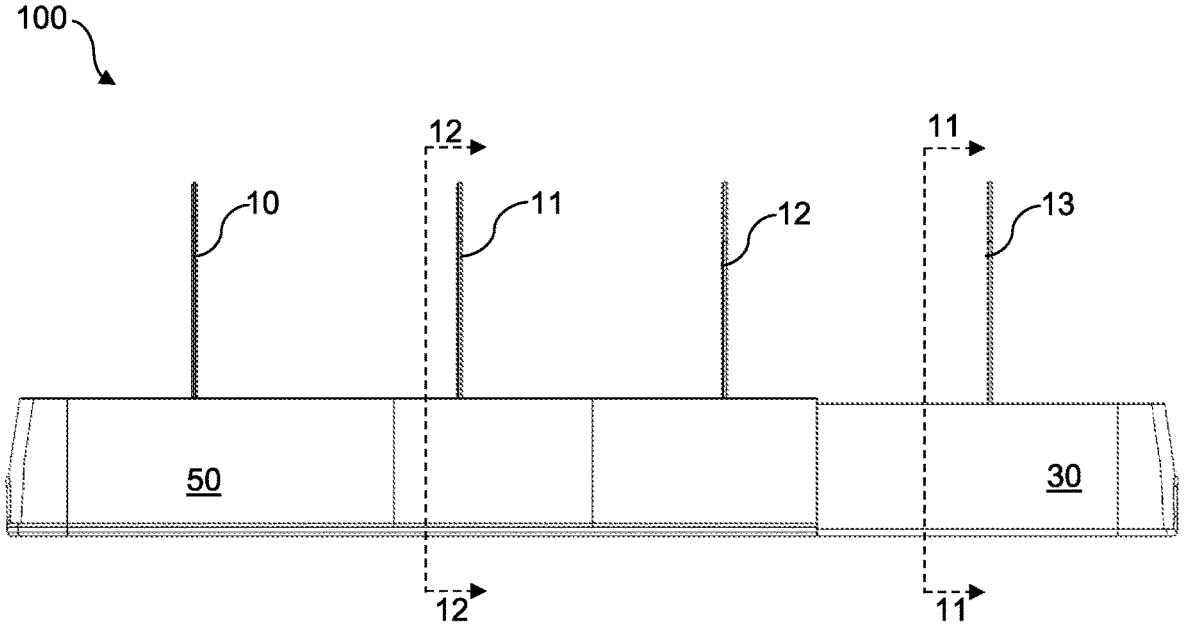
FIG. 4 is a rear elevational view of the adjustable rack, the front elevational view being a mirror image.
Figure 11:
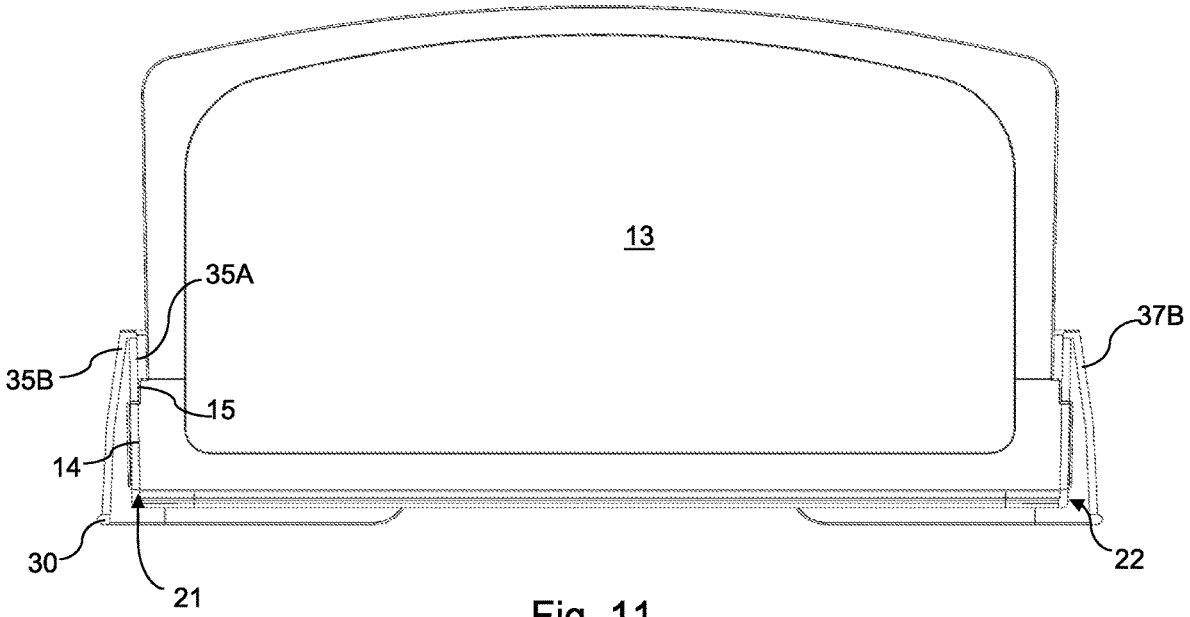
FIG. 11 is a sectional view of the preferred adjustable rack, taken along section plane 11-11 in FIG. 4.
Figure 12:
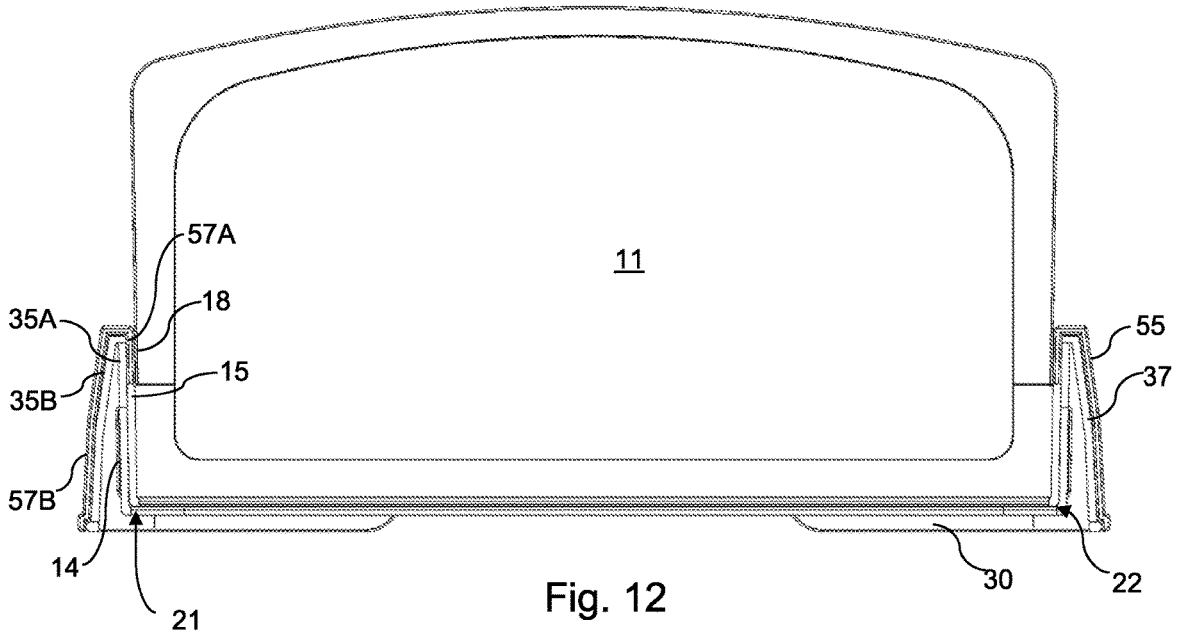
FIG. 12 is a sectional view of the preferred adjustable rack, taken along section plane 12-12 in FIG. 4.

FIG. 4 is a rear elevational view of the adjustable rack, again showing the first base section 50 and the second base section 30. Section planes 11-11 and 12-12 are indicated, and corresponding sectional views are shown in FIGS. 11 and 12.

Figure 5:
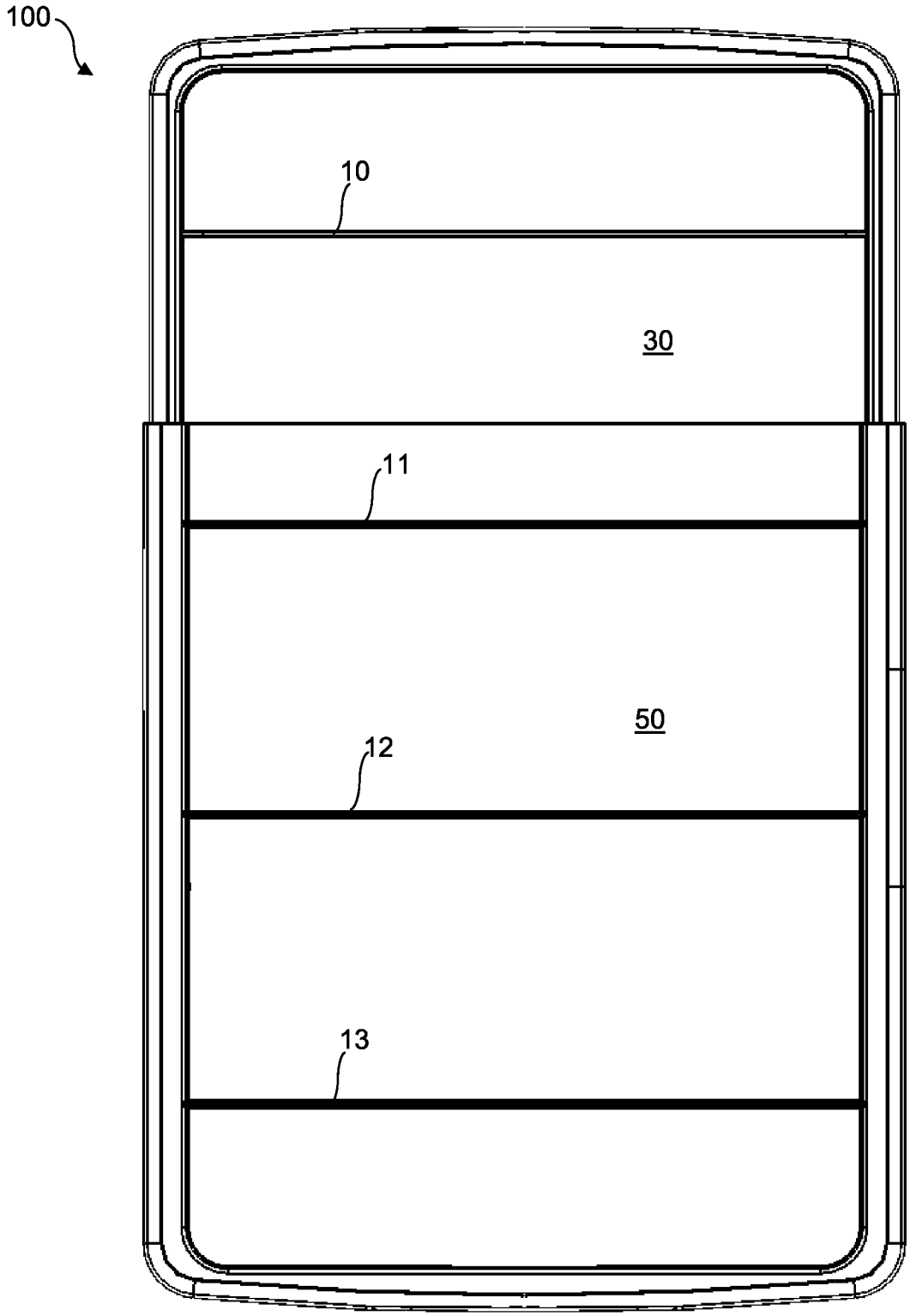
FIG. 5 is a top plan view of the adjustable rack.

FIG. 5 is a top plan view of the preferred adjustable rack.

Figure 6:
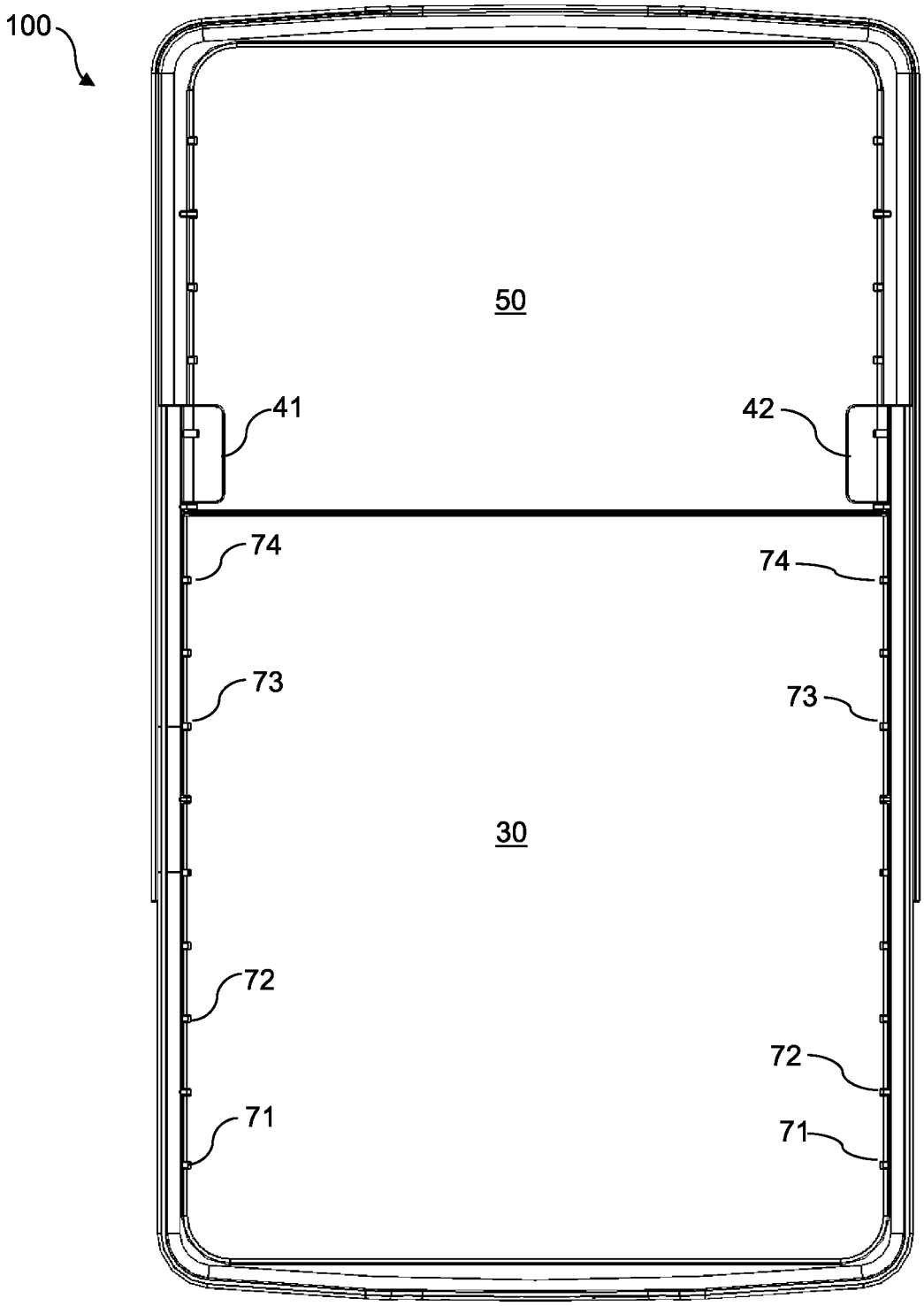
FIG. 6 is a bottom plan view of the adjustable rack.

FIG. 6 is a bottom plan view of the adjustable rack. In this view, a first locking tab 41 and second locking tab 42 formed in the second base section 30 are visible, shown connected to the first base section 50. The locations of the slots are visible in FIG. 6, in which the slots extend along the length of the rack (from the top to the bottom of the page, as illustrated), and are arranged as opposing pairs of slots, e.g, a first pair of slots 71 and a second pair of slots 72. When the sidewalls of the first and second base sections overlap with one another, pairs of slots likewise overlap, forming overlapping slots, e.g. 73, 74.

Figure 7:
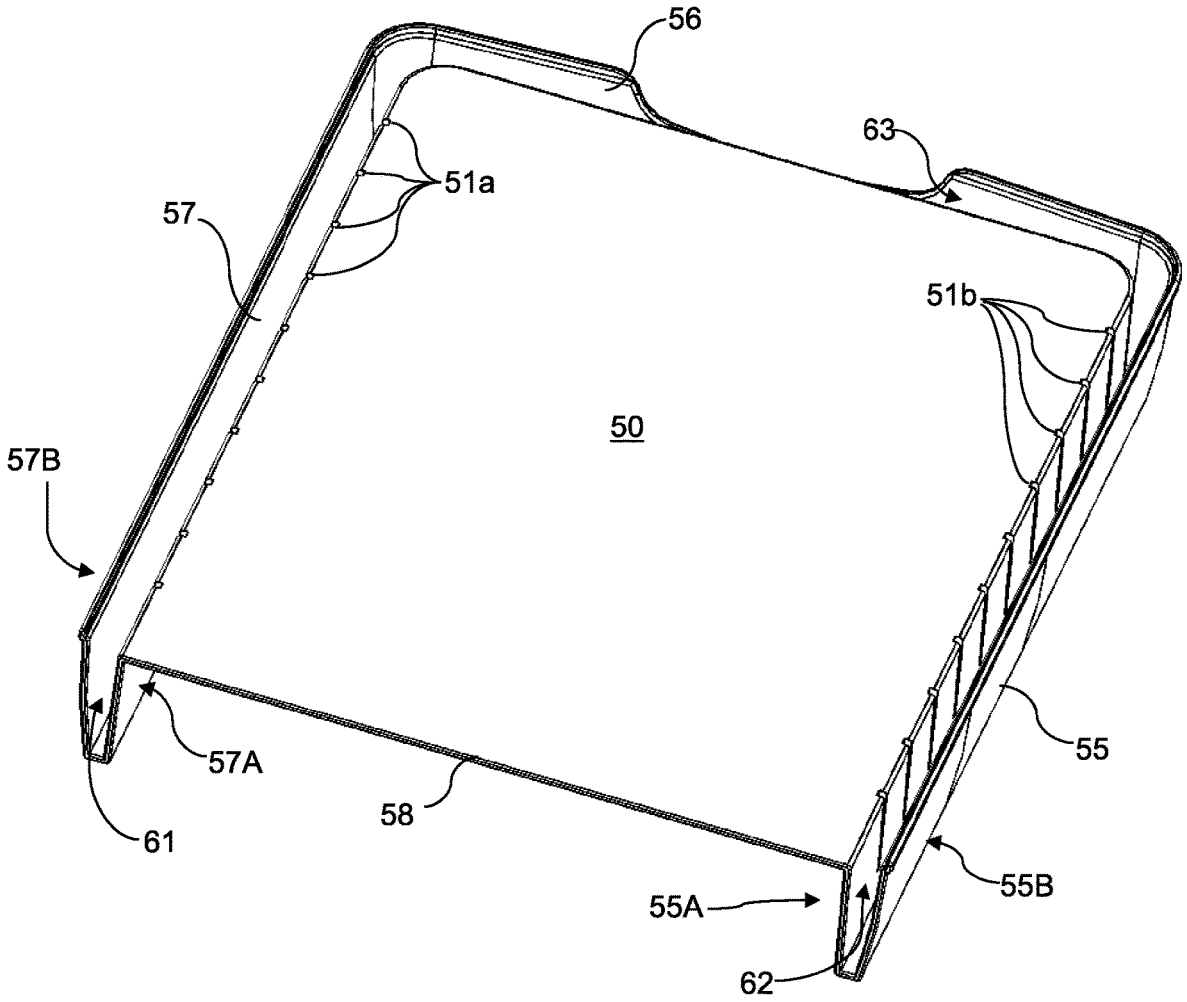
FIG. 7 is a bottom perspective view of a first base section of the adjustable rack.

FIG. 7 illustrates a bottom perspective view of the first base section 50, separated from the second base section. The first base section includes three peripheral upright walls, including an end wall 56, first sidewall 55, and opposing second sidewall 57. The first floor section 58 of the base spans between the end wall and first and second sidewalls.

In a preferred version as illustrated, the sidewalls are formed with inner and outer wall surfaces an interior channel to receive the sidewalls of the second base section, as described below. Thus, in one version the first sidewall 55 includes an interior wall surface 55A and an exterior wall surface 55B, with a first channel 62 formed within the first sidewall and between the interior and exterior surfaces. Likewise, the second sidewall 57 includes an interior wall surface 57A and an exterior wall surface 57B, with a second channel 61 formed within the second sidewall and between the interior and exterior surfaces. In the illustrated example, an end channel 63 is formed in the end wall 56 in the same manner. A plurality of slots are formed in the sidewalls, preferably arranged as opposing pairs 51*a*, 51*b*, with a pair including a slot 51*b* from the first sidewall 55 and a slot 51*a* from the second sidewall 57. Only some of the slots illustrated in the first base section 50 are numbered.

Figure 8:
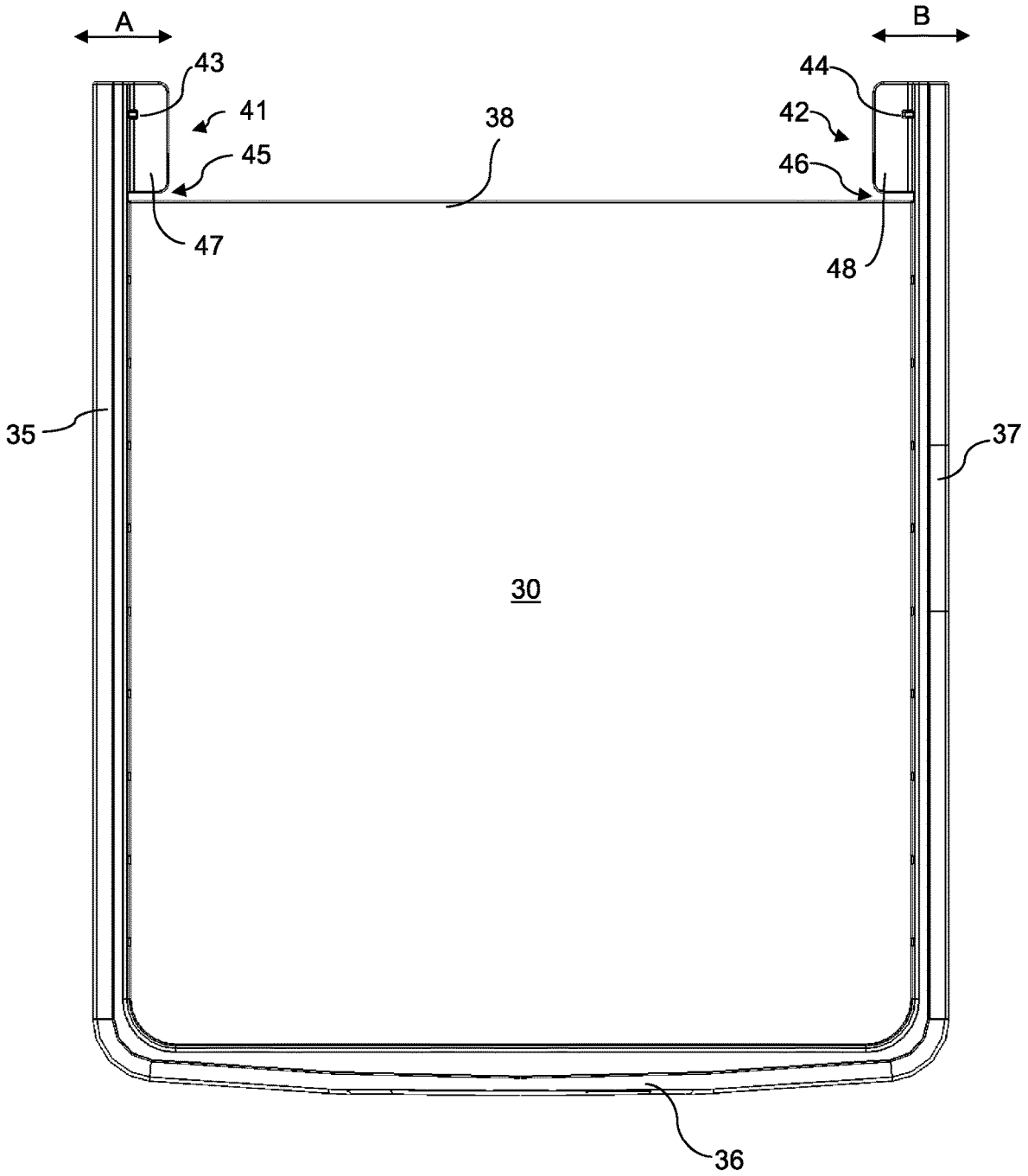
FIG. 8 is a top plan view of a second base section of the adjustable rack.

FIG. 8 is a top plan view of the second base section 30, showing the first and second locking tabs 41, 42. The first locking tab 41 includes a first horizontal foot 47 extending inwardly from a third sidewall 35 toward a fourth sidewall 37. The first horizontal foot preferably is planar, and co-planar with the second floor section 38 second base section 30. The first horizontal foot is separated from the base 38 by a gap 45 to thereby allow the locking tab to flex inwardly and outwardly (as indicated by arrow A) to either lock or release the locking tab. In a preferred version, the gap 45 extends horizontally as shown in FIG. 8, and continues vertically up the interior sidewall to serve as one of the slots 31*b*. A tongue 43 is formed on a vertical interior surface 35 of the first locking tab, and is sized and arranged to be received within a selected one of the slots 51*b* formed in the first base section 50.

Figure 9A:
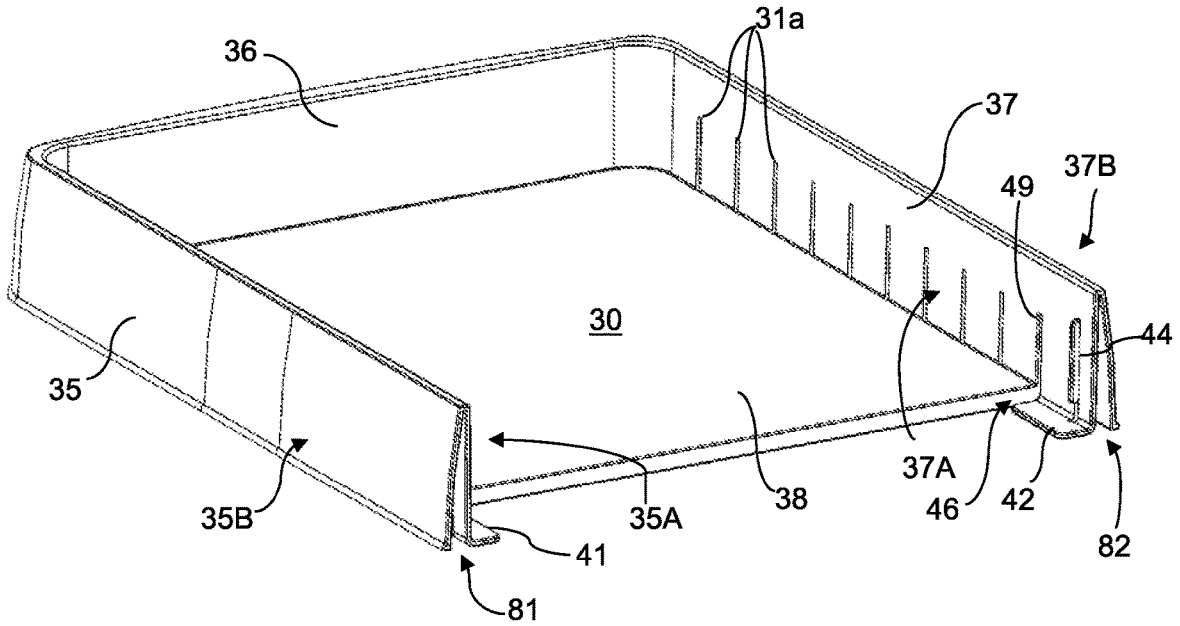
FIG. 9A is a top perspective view of the second base section of the adjustable rack.

The second locking tab 42 includes a second horizontal foot 48 extending inwardly from the fourth sidewall 37 toward the third sidewall 35. The second horizontal foot preferably is planar, and co-planar with the base 38 of the second base section 30. The second horizontal foot is separated from the base 38 by a gap 46 to thereby allow the locking tab to flex inwardly and outwardly (as indicated by arrow B) to either lock or release the locking tab. In a preferred version, the gap 46 extends horizontally as shown in FIG. 8, and continues vertically up the interior sidewall to serve as one of the slots 31*a*. With reference to FIG. 9A, the vertical slot portion 49 is illustrated. A corresponding vertical slot portion of the first locking tab is positioned on the opposite side and configured in the same manner. A tongue 44 is formed on a vertical interior surface of the first locking tab, and is sized and arranged to be received within a selected one of the slots 51*a* formed in the first base section 50.

FIG. 9A illustrates a top perspective view of the second base section 30. The second base section includes the third sidewall 35 which is preferably formed with an inner wall surface 35A and an exterior wall surface 35B, forming a third channel 81 between them. Similarly, the second base section includes the fourth sidewall 37 formed with an interior wall surface 37A and an exterior wall surface 37B, having a fourth channel 82 between them.

The first and second locking tabs 41, 42 are shown in FIG. 9A, and each is configured in the same way but on opposite sidewalls. The second locking tab 42 is shown with the gap comprising the horizontal gap 46 which continuously transitions to the vertical gap 49 formed on the interior sidewall 37A. The tongue 44 is positioned on the interior sidewall portion of the locking tab, and extends inwardly toward the opposite sidewall. The positioning of the gap and its horizontal and vertical portions allows the locking tab to flex outwardly when a user pries on the foot to apply an outwardly directed force. This force causes the tongue 44 to dislodge from a slot in which it may be seated, which in turn allows the second base section 30 to move telescopically with respect to the first base section.

When the first base section is joined to the second base section, the interior and exterior sidewall portions of the second base section are received within a corresponding channel 61, 62 of the first base section 50. The tongues 43, 44 of the locking tabs 41, 42 will fit within a selected one of the corresponding slots 51*a*, 51*b* to hold the first base section in a selected fixed position with respect to the second base section. By pressing on each of the first and second locking tabs in an outward direction to release the tongues from the slots, the first and second sections may be telescopically moved with respect to one another to either expand or collapse the base, as desired.

Figure 9B:
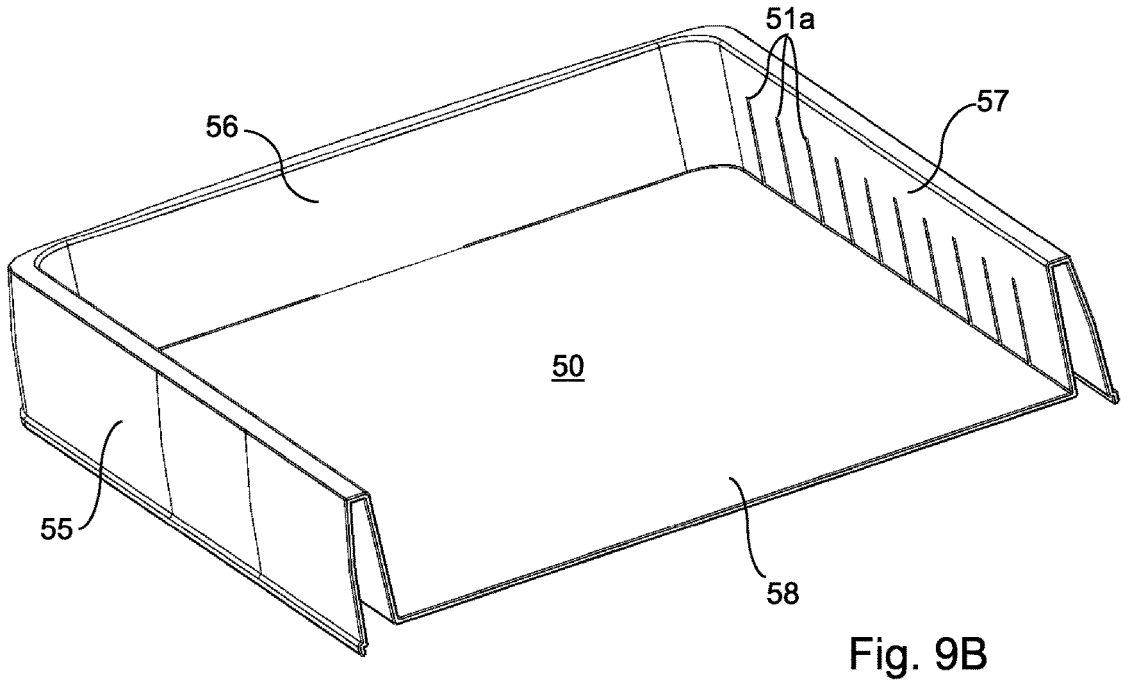
FIG. 9B is a top perspective view of the first base section of the adjustable rack.

FIG. 9B shows the first base section 50, including the vertical walls 55, 56, 57, and a plurality of slots 51*a*. Corresponding slots are formed on the end wall 55, evenly spaced apart in the same manner to form opposing pairs of slots, but not seen in FIG. 9B.

Figure 10:
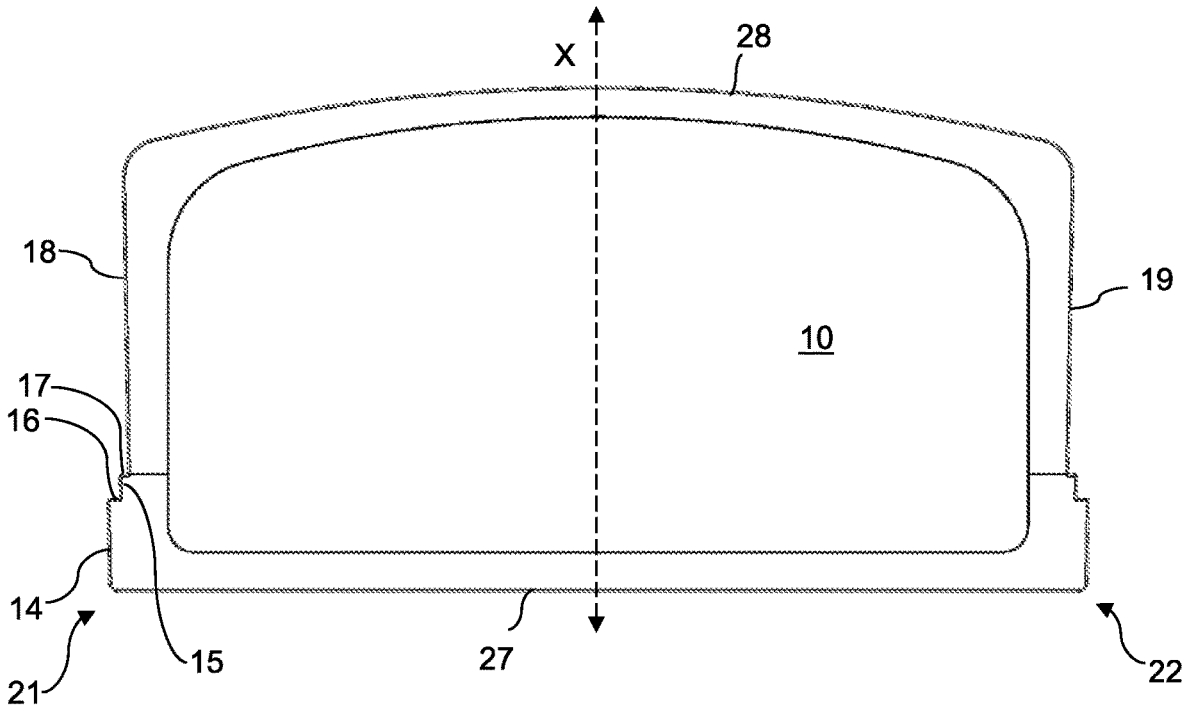
FIG. 10 is a front elevational view of a preferred divider for use with the adjustable rack.

FIG. 10 illustrates an elevational view of a preferred divider for use with the rack. The divider 10 is generally planar in shape, and extends between a first side 18 to a second side 19, and from a bottom 27 to a top 28. At the bottom end, each side includes a stepped divider tab 21, 22 arranged to be received within a selected slot formed in either the first base section or the second base section. Each of the first and second divider tabs 21, 22 are formed in the same manner, making the divider symmetrical about a central axis X, and therefore only one divider tab 21 will be addressed in detail.

The first divider tab 21 includes a lower tab 14 and an upper tab 15, in which the lower tab extends laterally outward beyond the upper tab. The lower tab 14 extends upwardly from the bottom of the divider 27 to a first upper edge 16. The upper tab 15 extends laterally outwardly beyond the first side 18 from the first upper edge 16 to a second upper edge 17, in which the second upper edge is positioned closer to the top 28 than is the first upper edge. Each of the upper tab and lower tab terminates laterally in a corresponding generally vertical end, in the vicinity of reference numbers 14 and 15, respectively, as indicated in FIG. 10.

The divider is configured to be received within a selected pair of slots, such as described above and such as is illustrated in FIG. 1. FIGS. 11 and 12 further illustrate sectional views of the dividers mounted in slots formed in either the first base section or the second base section.

With reference to FIG. 11, a divider 13 is shown positioned in a pair of slots formed in the second base section 30. More specifically, a portion of the second base section 30 is extended beyond the first base section such that the two sections do not overlap, and the divider is mounted to this non-overlapping region. The lower tab 14 is positioned within one of the slots (e.g., 31*a* shown in FIG. 9A, but not numbered in FIG. 11) formed in the interior sidewall 35A of the second base section. The lower tab 14 extends through the slot, while the vertical end of the upper slot 15 abuts the interior sidewall 35A of the second base section 30.

With reference to FIG. 12, a divider 13 is shown positioned in a pair of slots in the first base section 50 and a pair of slots in the second base section 30. Most preferably, each of the first and second base sections includes a plurality of slots formed in the respective interior sidewall on each side. The slots on one sidewall are positioned directly opposite the slots on the opposing side, and the slots in the first base section are spaced apart at the same distances along the sidewall as are the slots in the second base section. Accordingly, when the locking tabs position the first base section in a selected locked position with respect to the second base section, the slots in the first and second base sections overlap with one another on those portions of the interior sidewalls of the first and second base sections which also overlap.

When a divider 11 is positioned within slots that overlap as described above, such as illustrated in FIG. 12, the tab 21 extends through the overlapping slots. The lower tab 14 extends through a slot formed in the interior sidewall 57A of the first base section and also through the interior sidewall 35A of the second base section. Meanwhile, the upper tab 15 extends through the interior sidewall 57A of the first base section but abuts the interior sidewall 35A of the second base section.

Figure 13:
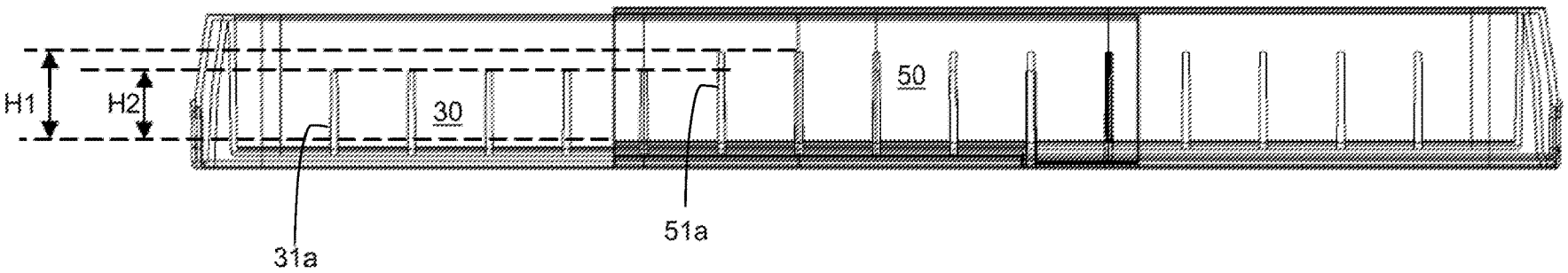
FIG. 13 is a front elevational view of the adjustable rack, shown as being transparent to make the slots visible, and with no dividers included.

The arrangement of the upper and lower tab seating and abutment is partially due to the heights of the slots in the base sections. As best seen in FIG. 13, the base sections are illustrated in a transparent form so that the slots 31*a*, 51*a* are visible through the sidewalls. The slots 31*a* formed in the second base section extend upwardly from a bottom of the base to a second height H2, while the slots 51*a* formed in the first base section extend upwardly from a bottom of the base to a first height H1, in which second height is less than the first height. Alternately stated, the slots in the first base section terminate at a location relatively closer to the top of the base than do the slots in the second base section. Accordingly, as described above, a divider tab can extend through the slot in the first base section while the upper tab abuts an interior sidewall of the second base section rather than extending through the slot in the second base section.

In use, a user can move the locking tabs apart to allow the first and second base sections to be adjusted telescopically to a desired length (measured from one end wall to the other end wall), and then release the locking tabs to secure the two base sections in position. One or more of a plurality of dividers can then be seated within a selected pair of slots in the opposing sidewalls, such that the divider tabs extend through a pair of slots in one or both of the first and second base sections, depending on the chosen location. The user can then store lids or other articles in compartment spaces defined between dividers, or between a divider and one of the end walls.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. An adjustable rack, comprising:

a base having a first base section telescopically connected to a second base section; the first base section having a first floor section, a first sidewall and an opposing second sidewall, and a first end wall between the first sidewall and the second sidewall, the first sidewall having an interior sidewall surface separated from an exterior sidewall surface by a first channel, the second sidewall having an interior sidewall surface separated from an exterior sidewall surface by a second channel; the second base section having a second floor section, a third sidewall and an opposing fourth sidewall, and a second end wall between the third sidewall and the fourth sidewall, the third sidewall having an interior sidewall surface separated from an exterior sidewall surface by a third channel, the fourth sidewall having an interior sidewall surface separated from an exterior sidewall surface by a fourth channel;

a first plurality of slots arranged in opposing pairs positioned along the interior surfaces of the first sidewall and the second sidewall;

a second plurality of slots arranged in opposing pairs positioned along the interior surfaces of the third sidewall and the fourth sidewall;

the third sidewall being received within the first channel and the fourth sidewall being received within the second channel when the first base section is telescopically connected to the second base section;

the second base section further having a planar first locking tab foot and a spaced apart first tongue that both extend in the same direction, wherein the first locking tab foot is larger than the first tongue, and a second locking tab having a second tongue, the first tongue and the second tongue each being received within a selected one of the first plurality of slots to releasably secure the first base section to the second base section; and one or more dividers, each of the one or more dividers including a pair of opposing tabs, each one of the pair of opposing tabs being removably receivable within a selected one of the slots from among the first plurality of slots or the second plurality of slots.

2. The adjustable rack of claim 1, wherein the first locking tab foot is separated from the second floor section by a first gap, the first gap further extending upwardly along a portion of the first sidewall.

3. The adjustable rack of claim 2, wherein the second locking tab includes a second horizontal foot separated from the second floor section by a second gap, the second gap further extending upwardly along a portion of the second sidewall.

4. The adjustable rack of claim 3 wherein the first tongue is positioned on the interior sidewall surface of the third sidewall, and the second tongue is positioned on the interior sidewall surface of the fourth sidewall.

5. The adjustable rack of claim 4, wherein the first plurality of slots extend to a first height above the second floor section when the first base section is telescopically connected to the second base section, and the second plurality of slots extend to a second height above the second floor section when the first base section is telescopically connected to the second base section, the first height being greater than the second height.

6. The adjustable rack of claim 1, wherein the first plurality of slots extend to a first height above the second floor section when the first base section is telescopically connected to the second base section, and the second plurality of slots extend to a second height above the second floor section when the first base section is telescopically connected to the second base section, the first height being greater than the second height.

7. The adjustable rack of claim 6, wherein at least some pairs of the first plurality of slots overlap with at least some pairs of the second plurality of slots when the first base section is telescopically connected to the second base section, and further wherein each one of the pair of opposing tabs of the one or more dividers is removably receivable within a selected one of the first plurality of slots overlapping with the second plurality of slots.

8. The adjustable rack of claim 7, wherein each of the tabs of the one or more dividers comprises an upper tab and a lower tab, the lower tab sized to extend through a slot from among the first plurality of slots and a slot from among the second plurality of slots, the upper tab sized to extend through a slot from among the first plurality of slots.

9. The adjustable rack of claim 8, wherein a corresponding upper tab abuts the third sidewall when the lower tab extends through the selected one of the first plurality of slots overlapping with the second plurality of slots.

10. The adjustable rack of claim 1, wherein each of the one or more dividers is planar and includes a first side, a second side, a top, and a bottom, and further wherein each of the opposing tabs comprises a stepped divider tab having an upper tab and a lower tab, the lower tab extending laterally outward beyond the upper tab.

11. The adjustable rack of claim 10, wherein the lower tab of a corresponding divider extends upwardly from the bottom of the corresponding divider to a first upper edge and the upper tab of the corresponding divider extends upwardly from the bottom of the corresponding divider to a second upper edge, the second upper edge being positioned relatively closer to the top of the corresponding divider.

12. An adjustable rack, comprising:

a base having a first base section telescopically connected to a second base section;

the first base section having a first floor section, a first sidewall and an opposing second sidewall, and a first end wall between the first sidewall and the second sidewall, the first sidewall having an interior sidewall surface separated from an exterior sidewall surface by a first channel, the second sidewall having an interior sidewall surface separated from an exterior sidewall surface by a second channel; the second base section having a second floor section, a third sidewall and an opposing fourth sidewall, and a second end wall between the third sidewall and the fourth sidewall, the third sidewall having an interior sidewall surface separated from an exterior sidewall surface by a third channel, the fourth sidewall having an interior sidewall surface separated from an exterior sidewall surface by a fourth channel; a first plurality of vertical slots arranged along the interior surfaces of the first sidewall and the second sidewall;

a second plurality of vertical slots arranged along the interior surfaces of the third sidewall and the fourth sidewall, at least some of the first plurality of vertical slots being positioned to overlap with the second plurality of vertical slots when the first base section is telescopically connected to the second base section in a collapsed position to form overlapping slots;

the third sidewall being received within the first channel and the fourth sidewall being received within the second channel when the first base section is telescopically connected to the second base section;

a first locking tab formed on and extending inwardly from one of the interior surfaces of the second base section to releasably lock the first base section to the second base section in a collapsed position or an expanded position;

wherein the first locking tab is configured to be pressed outwardly from the one of the interior surfaces of the second base section to release a tongue from one of the vertical slots to telescopically move the first and second sections with respect to one another to either expand or collapse the base; and a plurality of dividers, each of the dividers including first tab and a second tab, each one of the first tabs and the second tabs being removably receivable within a selected one of the first plurality of vertical slots, the second plurality of vertical slots, or the corresponding overlapping slots.

13. The adjustable rack of claim 12, wherein the first locking tab includes a first horizontal foot separated from the second floor section by a first gap, the first gap further extending upwardly along a portion of the first sidewall.

14. The adjustable rack of claim 13, further comprising a second locking tab, the second locking tab having a second horizontal foot separated from the second floor section by a second gap, the second gap further extending upwardly along a portion of the second sidewall.

15. The adjustable rack of claim 13, wherein the tongue of the first locking tab is a first tongue, the first tongue being positioned on the interior sidewall surface of the third sidewall.

16. The adjustable rack of claim 15, wherein the first plurality of vertical slots extend to a first height above the second floor section when the first base section is telescopically connected to the second base section, and the second plurality of vertical slots extend to a second height above the second floor section when the first base section is telescopically connected to the second base section, the first height being greater than the second height.

17. The adjustable rack of claim 12, wherein the first plurality of vertical slots extend to a first height above the second floor section when the first base section is telescopically connected to the second base section, and the second plurality of vertical slots extend to a second height above the second floor section when the first base section is telescopically connected to the second base section, the first height being greater than the second height.

18. The adjustable rack of claim 17, wherein the first and second tabs of each divider each comprises an upper tab and a lower tab, wherein the lower tab is sized to extend through a corresponding slot from among the first plurality of vertical slots and a corresponding slot from among the second plurality of vertical slots, and wherein the upper tab is sized to extend through the corresponding slot from among the first plurality of vertical slots but does not extend through a corresponding slot from the second plurality of vertical slots.

19. The adjustable rack of claim 18, wherein the upper tab abuts the third sidewall when the lower tab extends through the selected one of the first plurality of vertical slots overlapping with the second plurality of vertical slots.

20. The adjustable rack of claim 17, wherein each of the dividers is planar and includes a first side, a second side, a top, and a bottom, and further wherein each of the first and second tabs comprises a stepped divider tab having an upper tab and a lower tab, the lower tab extending laterally outward beyond the upper tab.

* * * * *